US006354823B1

(12) United States Patent
Becher et al.

(10) Patent No.: US 6,354,823 B1
(45) Date of Patent: Mar. 12, 2002

(54) DISPLACEMENT MACHINE HAVING A CERAMIC ROLLING BEARING

(75) Inventors: Ulrich Becher, Porrentruy (CH); Andreas Basteck, Lörrach (DE)

(73) Assignee: Ateliers Busch SA, Chevenez (CH)

( * ) Notice: Subject to any disclaimer, the term of this patent is extended or adjusted under 35 U.S.C. 154(b) by 0 days.

(21) Appl. No.: 09/647,886

(22) PCT Filed: Apr. 1, 1999

(86) PCT No.: PCT/CH99/00137

§ 371 Date: Oct. 6, 2000

§ 102(e) Date: Oct. 6, 2000

(87) PCT Pub. No.: WO99/54627

PCT Pub. Date: Oct. 28, 1999

(30) Foreign Application Priority Data

Apr. 21, 1998 (EP) ..... 98810350

(51) Int. Cl.[7] ..... F01C 1/16; F01C 21/02; F01C 18/16

(52) U.S. Cl. ..... 418/104; 418/201.1

(58) Field of Search ..... 418/102, 104, 418/201.1, 206.6, 206.7

(56) References Cited

U.S. PATENT DOCUMENTS

| | | | | | |
|---|---|---|---|---|---|
| 1,751,703 | A | * | 3/1930 | Long | 418/102 |
| 2,633,083 | A | * | 3/1953 | Smith | 418/102 |
| 2,705,922 | A | * | 4/1955 | Rathman | 418/201.1 |
| 4,674,960 | A | * | 6/1987 | Rando et al. | 418/104 |
| 5,269,667 | A | * | 12/1993 | Mauney | 418/201.1 |
| 5,540,575 | A | * | 7/1996 | Takano et al. | 418/201.1 |
| 5,580,232 | A | * | 12/1996 | McEndarfer | 418/201.1 |

FOREIGN PATENT DOCUMENTS

| | | |
|---|---|---|
| DE | 3706588 C 1 | 8/1988 |
| DE | 195 13 380 A 1 | 10/1996 |
| DE | 195 22 551 A 1 | 1/1997 |
| EP | 0 376 373 A 1 | 4/1990 |

* cited by examiner

*Primary Examiner*—John J. Vrablik
(74) *Attorney, Agent, or Firm*—Oliff & Berridge, PLC

(57) ABSTRACT

The displacement machine is intended in particular for use as a pump, and has a working area, formed in a housing, which working area is limited by two end walls and a casing, and is accessible via an inlet and an outlet for a working medium. At least one rotor, movably disposed in the housing, subdivides the working area, and a guide gearing for rotor control is connected to a drive apparatus located outside the working area. The invention has as its object to propose a displacement machine which can be manufactured less expensively and with less weight than known displacement machines of this type, and in particular can be operated without any special lubricant for the bearings. This object is attained in that the rotor, or respectively the rotors, is or are, supported at least partially inside the working area, and in that the bearing or bearings, disposed inside the working area, is, or are, accessible for the working medium, and is, or are, designed as rolling bearing made of ceramic materials, making possible operation of the displacement machine without lubricants. Contamination of the working medium from lubricant is thereby practically excluded.

5 Claims, 1 Drawing Sheet

DISPLACEMENT MACHINE HAVING A CERAMIC ROLLING BEARING

Figure 1:
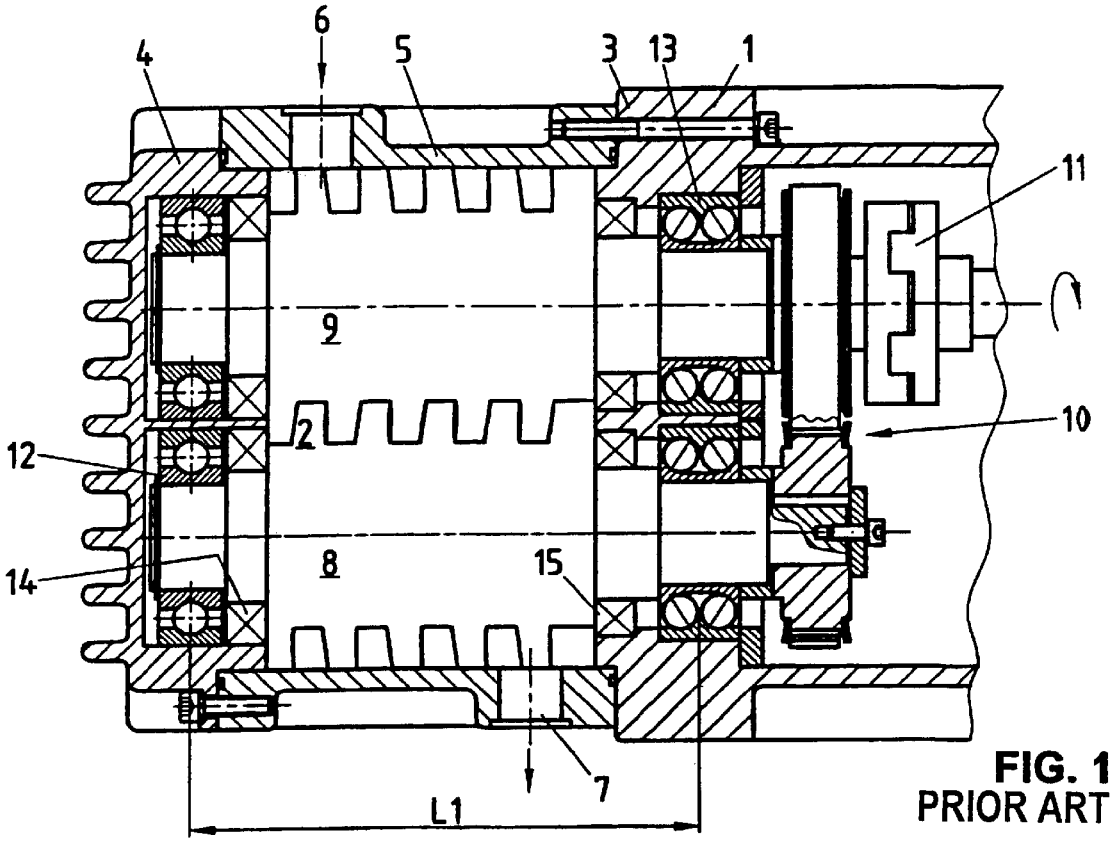
FIG. 1 PRIOR ART

The invention relates to a displacement machine, in particular for use as a pump, with a working area formed in a housing, which working area is limited by two end walls and a casing, and is accessible for a working medium via an inlet and an outlet, and at least one rotor, subdividing the working area, movably disposed in the housing, and a guide gearing for rotor control, and a drive apparatus situated outside the working area.

Displacement machines of this kind are known in many different types. They can be designed and used for supply of a medium under pressure, for example air, as well as designed and used as vacuum pumps. In many areas of application of such machines, in particular in the packaging and food industry, the pressurized medium must not be contaminated with oil. It is therefore essential that the machines get by without oil in the working area. With respect to the rotors, the problem has been resolved with geometries which allow a contact-free engagement of the rotors, so that the latter do not have to be lubricated with oil. More of a problem, however, is the bearing of the rotors, as will be explained in the following with reference to some typical examples.

In a first type of displacement machine of the initially mentioned type, the rotors are supported by means of sliding bearings. Sliding bearings are known today which have very good dry running features, for example those with coatings of silicon carbide. Although such bearings are capable of withstanding an operation without lubricant for some time without damage, for example during start-up of the machine or during interruption of the lubricant supply until the machine is stopped, they are not suited, however, to non-lubricated continuous operation. There are some cases in which the medium for lubrication of the bearings required by the machine can be brought in, especially if this medium is liquid. In all other cases, nothing else can be done except to seal off the bearings with respect to the working area if the working medium is supposed to be protected against contamination from lubricants. This takes place in most cases by means of dynamic seals. The most important problems of constructions of this incomplete tightness as well as possibly arising friction, and the heat connected therewith, as well as the limited life of the seals. Belonging to this type of displacement machine, for example, is the screw-type compressor described in the document DE 31 24 247 C1. To simplify the manufacture of this screw-type compressor, both slides are made of ceramic material at least in the region of the screw profile. It is also indicated in this document that it is useful to support the slides by means of sliding bearings, the sliding bearing bush being made expediently of silicon carbide and the shaft in the bearing regions being preferably coated with ceramic material. Furthermore it is expressly pointed out that a lubricant is needed for these bearings, and that this lubricant is preferably water.

A second type of displacement machine works with hydrodynamic or hydrostatic bearings. Of course sealing problems present themselves here, too, as soon as the working area is not allowed to be contaminated with lubricants. Overcoming these sealing problems requires greater complexity of construction, which increases the weight of the machine in an undesirable way. An example of a machine with hydrostatic bearings is described in the European Patent Application EP 0 376 373 A1. In this type of displacement machine the weight and the complexity of construction are increased even further through the installations necessary for providing the lubricant pressure.

A third type of displacement machine is equipped with magnetic bearings for the rotor shaft. Such bearings have in themselves a relatively great weight. Because of the relatively minimal forces which can be absorbed by magnetic bearings, the rotors must be driven by separate, electronically synchronized motors, and cannot be synchronized with a guide gearing. A mechanical emergency synchronization mechanism is frequently provided, however, for the event of a failure of the synchronizing mechanism.

Still another type of displacement machine has shafts with one-sided bearing support, the bearing being provided on the pressure side of the working area. German published patent application DE 195 22 551 A1 shows such a machine. It is apparent that also with this kind of displacement machine the complexity of construction is considerable.

A fourth, widespread type of displacement machine operates with rolling bearings which are conventionally lubricated and are dynamically sealed with respect to the working area. In a first subtype of this kind, the rotors have bearing support on both sides, as is shown, for example, in the German patent DE 37 06 588 C1. It can clearly be seen on the drawings of this document that with a given length of the working area, the support length between the bearings is enlarged by the seals needed for their sealing. It is clear that, with increasing support width, the tendency for transverse vibrations of the rotors and thus the risk of rotor contact increases. To counteract this risk, the root diameter of the rotors also are designed correspondingly larger. The construction dimensions and the weight of the machine is thereby increased. In another machine of this kind according to German published patent application DE 195 13 380 A1, the bearing is achieved on one side inside the rotor, which has a bore instead of a bearing journal for this purpose. The support width between the bearings is thereby decreased, but the expenditure for sealing the bearings with respect to the working area is not reduced. A second subtype of the aforementioned fourth type works with rotors with one-sided bearing support. An application for a Swiss patent for such a machine was filed by the applicant on Jul. 15, 1997, under the number 1737/97. This machine has the particular advantage that only a single bearing must be sealed, and to be more precise, the bearing on the pressure side of the working area. This sealing of the working area presents fewer problems also because the risk of a contamination of the working medium is much smaller with the pressure-side seal than with the suction-side. Compared to the aforementioned, however, no construction volume is saved through this construction, whereby application is limited to smaller pumps.

The present invention has as its object to propose a displacement machine of the initially mentioned type which can be manufactured less expensively and with less weight than known displacement machines of this type, and in particular can be operated without special lubricants for the bearings. This object is attained in that the rotor or rotors is or are supported at least partially inside the working area, and in that the bearing or bearings disposed inside the working area is or are accessible for the working medium and is or are designed as rolling bearings made of ceramic materials, whereby a lubricant-free operation of the displacement machine is possible. The machine according to the invention can thus be operated without special lubricants for the bearings, and a contamination of the working medium with lubricant is thereby practically excluded.

In one embodiment of the invention, two rotors (8, 9), having parallel axes and meshing with one another in external engagement, are rotatably disposed in the housing (1), and each rotor has a shaft end, with dynamic sealing, led out on one side through a bore in the first end wall (3), and is supported on the opposite end face by a ceramic rolling bearing (16) which is fixed on the inside to the second end wall (4), designed as a blind cap, and is protected from the working area through a friction-free labyrinth seal (18) or is freely accessible. In this embodiment, the need for sealing on both sides is eliminated, making possible a reduction of the support widths between the bearings. The expenditure during construction of the machine is thereby reduced as well as the weight of the machine and its construction volume.

In an especially preferred embodiment of the inventive displacement machine, for use as a vacuum pump, having the features cited in the preceding paragraph, the geometry of the rotors is screw-shaped or screw-like, and the machine thus operates with a primarily axial direction of conveyance, and the inlet (6) is provided on the blind cap end wall (4) in the vicinity of the ceramic rolling bearing (12) and the outlet (7) on the shaft-end side. This preferred embodiment allows a simple, two-sided bearing support of the rotors with a reduction of the support widths as well as an operation without suction-side dynamic seals and a general construction volume reduction. Doing without suction-side seals is particularly advantageous with vacuum pumps because a failure of such a seal would lead to a contamination of the working medium or to collapse of the vacuum in a machine with conventionally lubricated bearings.

In another embodiment, having the features cited in either one of the preceding paragraphs but where the rotor bearings (17) are likewise formed by inner-situated ceramic rolling bearings on the end wall (3) with the shaft lead-throughs, a lubricant-free operation of the machine is likewise made possible as well as a further reduction of the rotor support widths. Above and beyond this, the dynamic shafts are accessible from outside and are replaceable in this embodiment.

Figure 2:
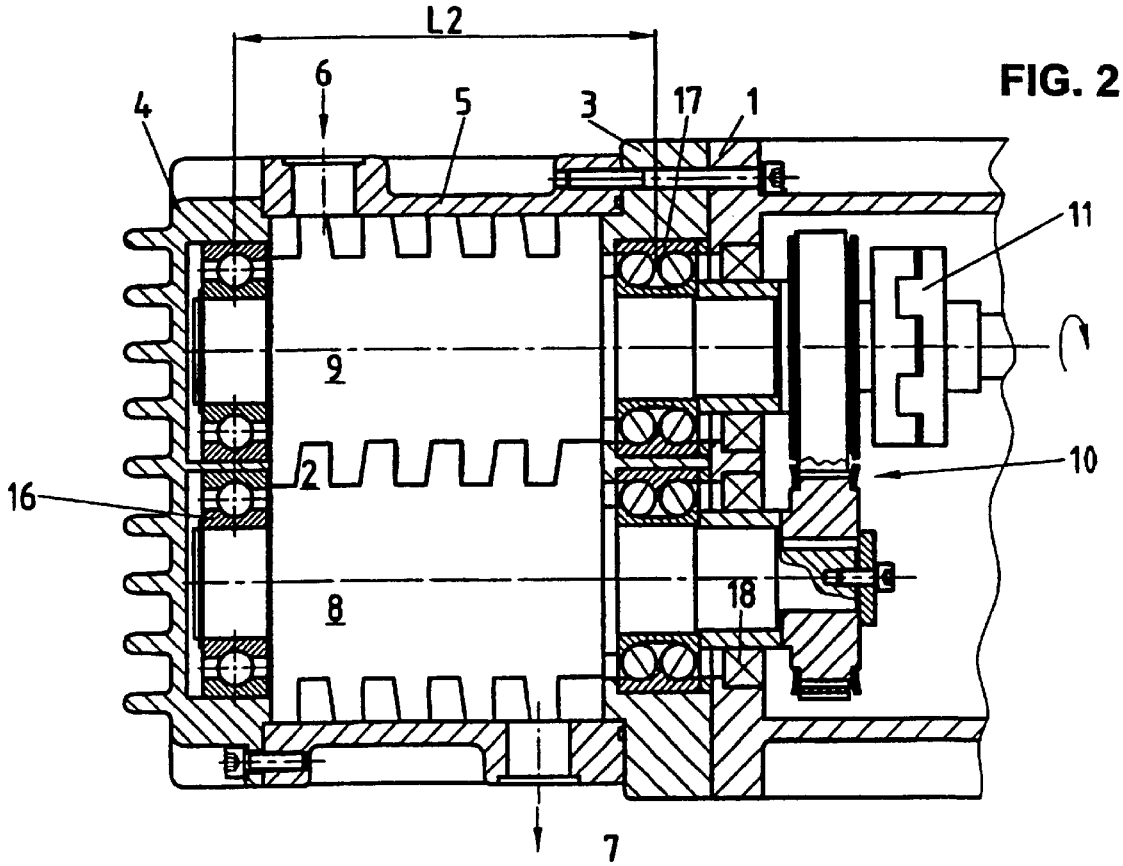

The state of the art and a special embodiment of the invention will be explained more closely in the following, with reference to the attached drawings:

FIG. 1 is a longitudinal section through a displacement machine according to the state of the art, and FIG. 2 is a longitudinal section through an embodiment example of the displacement machine according to the invention.

FIG. 1 shows a longitudinal section through a displacement machine according to the state of the art, which is intended for use as a pump. Formed in a housing 1 is a working area 2, which is limited by two end walls 3, 4 and a casing 5. Via an inlet 6, the working medium, for example air, is sucked into the working area and is expelled therefrom via an outlet 7. Rotatably disposed in the working area are two rotors 8, 9, provided in a known way with screw-shaped profiles, engaging in one another, on their generated surface. A guide gearing 10, disposed outside the working area and driven by a drive apparatus 11, ensures that the two rotors rotate in opposite rotational directions without touching. The rotors 8 and 9 are supported with two conventional rolling bearings 12 and 13 each in the end walls 3, or respectively 4, and are sealed off with respect to the working area 2 with seals 14 and 15. The resultant support width with this configuration is designated by L1 in FIG. 1.

In the displacement machine according to the invention, of which one embodiment example is depicted in FIG. 2, the rotors 8 and 9 are supported by means of rolling bearings 16 and 17 in the working area 2. Since these rolling bearings are constructed with ceramic materials which can achieve a high life without lubrication, or respectively with lubrication by means of the working medium alone, the seals 14 and 15 shown in FIG. 1 can be done away with. The rotors thus having bearing support in the working area, the considerably smaller support width L2, compared to the state of the art shown in FIG. 1, being the result. The working area 2 needs only to be sealed off on the side of the guide gearing 10, which takes place in the present example through the dynamic friction-free labyrinth seal 18 disposed on the side of the bearing 17 remote from the working area.

What is claimed is:

1. A displacement machine, in particular for use as a pump, comprising:

a housing with a working area formed therein limited by two end walls and a casing, an inlet and an outlet via which access is provided for a working medium, at least one rotor, subdividing the working area, movably disposed in the housing, at least one bearing, a guide gearing for rotor control, and a drive apparatus situated outside the working area, wherein the at least one rotor is disposed at least partially within the working area, and the at least one bearing, supported within the working area, is accessible to the working medium and is designed as a rolling bearing made of ceramic materials, making possible a lubricant-free operation of the displacement machine.

2. The displacement machine according to claim 1, wherein two rotors, having parallel axes and meshing with one another in external engagement, are rotatably disposed in the housing, and each rotor has a shaft end, with dynamic sealing, led out on one side through a bore in the first end wall, and is supported on the opposite end face by a ceramic rolling bearing which is fixed on the inside to the second end wall, designed as blind cap, and is protected from the working area through a friction-free labyrinth seal or is freely accessible.

3. The displacement machine according to claim 2, wherein the rotor bearings are likewise formed by inner-situated ceramic rolling bearings on the end wall with the shaft lead-throughs.

4. The displacement machine according to claim 2, for use as a vacuum pump, wherein the geometry of the rotors is substantially screw-shaped, and the machine thus operates with a primarily axial direction of conveyance, and the inlet is provided close to the blind cap end wall in the vicinity of the ceramic rolling bearing and the outlet on the shaft-end side.

5. The displacement machine according to claim 4, wherein the rotor bearings are likewise formed by inner-situated ceramic rolling bearings on the end wall with the shaft lead-throughs.

* * * * *